US009774092B2

(12) United States Patent
Fujii et al.

(10) Patent No.: US 9,774,092 B2
(45) Date of Patent: Sep. 26, 2017

(54) DEPLOYABLE ANTENNA REFLECTOR

(71) Applicants: Kiyoshi Fujii, Tokyo (JP); Minoru Tabata, Tokyo (JP); Kyoji Shintate, Ibaraki (JP)

(72) Inventors: Kiyoshi Fujii, Tokyo (JP); Minoru Tabata, Tokyo (JP); Kyoji Shintate, Ibaraki (JP)

(73) Assignee: NEC Space Technologies, Ltd., Tokyo (JP)

( * ) Notice: Subject to any disclaimer, the term of this patent is extended or adjusted under 35 U.S.C. 154(b) by 268 days.

(21) Appl. No.: 13/763,148

(22) Filed: Feb. 8, 2013

(65) Prior Publication Data

US 2013/0207881 A1 Aug. 15, 2013

(30) Foreign Application Priority Data

Feb. 9, 2012 (JP) ..... 2012-025983

(51) Int. Cl.

| | |
|---|---|
| ***H01Q 15/20*** | (2006.01) |
| ***H01Q 15/14*** | (2006.01) |
| ***H01Q 1/28*** | (2006.01) |
| *H01Q 15/16* | (2006.01) |

(52) U.S. Cl.
CPC ..... *H01Q 15/147* (2013.01); *H01Q 1/288* (2013.01); *H01Q 15/161* (2013.01); *H01Q 15/168* (2013.01); *H01Q 15/20* (2013.01)

(58) Field of Classification Search
CPC .. H01Q 15/147; H01Q 15/161; H01Q 15/168; H01Q 15/20
USPC ..... 343/840, 915, 916
See application file for complete search history.

(56) References Cited

U.S. PATENT DOCUMENTS

| | | | | |
|---|---|---|---|---|
| 4,896,165 | A * | 1/1990 | Koizumi | 343/881 |
| 4,989,015 | A * | 1/1991 | Chang | 343/915 |
| 5,680,145 | A | 10/1997 | Thomson et al. | |
| 6,028,570 | A * | 2/2000 | Gilger | H01Q 1/288 343/880 |
| 6,278,416 | B1 | 8/2001 | Harless | |
| 6,901,714 | B2 * | 6/2005 | Liapi | 52/645 |
| 7,216,995 | B2 | 5/2007 | Harada et al. | |
| 2005/0104798 | A1 | 5/2005 | Nolan et al. | |
| 2007/0200789 | A1 | 8/2007 | Bassily | |

FOREIGN PATENT DOCUMENTS

| | | | |
|---|---|---|---|
| EP | 0959524 | A1 | 11/1999 |
| JP | 4172803 | A | 6/1992 |
| JP | 200027302 | A | 1/2000 |
| JP | 2006-080578 | A | 3/2006 |
| JP | 200680577 | A | 3/2006 |
| JP | 2009-528782 | A | 8/2009 |
| WO | 03003517 | A1 | 1/2003 |

OTHER PUBLICATIONS

Communication dated Mar. 27, 2013 from the European Patent Office in counterpart application No. 13154250.8.
Communication dated Dec. 24, 2015 from the Japanese Patent Office in counterpart application No. 2012-25983.

* cited by examiner

*Primary Examiner* — Joseph Lauture
(74) *Attorney, Agent, or Firm* — Sughrue Mion, PLLC

(57) ABSTRACT

A deployable antenna reflector includes a surface cable network formed of a plurality of cables coupled to each other in a mesh pattern. The surface cable network includes at least one rigid rod member that reduces a maximum tensile force caused in the surface cable network.

14 Claims, 6 Drawing Sheets

DEPLOYABLE ANTENNA REFLECTOR

This application is based upon and claims the benefit of priority from Japanese patent application No. 2012-25983, filed on Feb. 9, 2012, the disclosure of which is incorporated herein in its entirety by reference.

BACKGROUND

The present invention relates to a deployable antenna reflector, and more particularly to a reflector surface of a deployable antenna reflector.

A related deployable antenna reflector has surface cables, a metal mesh attached to the surface cables, back cables arranged behind the metal mesh, and a deployable framework truss structure to which the surface cables, the metal mesh, and the back cables are attached. For example, this type of reflection mirrors is disclosed in JP-A 2006-080578 or WO2007/100865.

Another related deployable antenna reflector has flexible compression members attached to the outermost ones of codes provided between support structures so that those codes are arched. For example, this type of reflection minors is disclosed in U.S. Pat. No. 6,278,416.

SUMMARY

Because of restrictions on the stowage capacity of a launch vehicle used for transportation to an outer space, a plurality of small-sized deployable modules have generally been combined with each other to increase the diameter of a deployable antenna reflector. With this method, however, each of the deployable modules requires an deployment drive mechanism. Therefore, the weight of a deployable antenna reflector problematically increases at a high rate when the diameter of the deployable antenna reflector is to be increased. Thus, there have been made attempts to increase the diameter of a deployable antenna reflector at an unfolded state while the size of each of deployable modules being folded is not varied or is reduced.

The inventors have invented an antenna deployment mechanism capable of both reduction in size at a folded state and increase in diameter at an unfolded state. However, the inventors have found that the weight of a deployable antenna reflector increases at a high rate when an antenna reflector surface is attached to such an antenna deployment mechanism.

More specifically, a reflector surface of a deployable antenna reflector (or a deployable module) is formed of a flexible metal mesh. This metal mesh is folded when the antenna is folded, and unfolded when the antenna is unfolded. In order to form the metal mesh into a desired shape (a desired reflector surface) when the antenna is unfolded, a surface cable network in which a plurality of cables are arranged in a mesh pattern is used. The surface cable network is stretched without the slack, so that each of facets (meshes) of the metal mesh attached to the surface cable network is made flat.

If an area of the metal mesh is increased to enlarge the reflector surface, the surface cable network needs to be increased in size. Cables of the surface cable network are lengthened due to the increase in size of the surface cable network. Therefore, large tensile forces are required to maintain the reflector surface with a desired shape. Loads applied to the antenna deployment mechanism for supporting those cables are also increased. As a result, the strength of the cables and the antenna deployment mechanism need to be enhanced, resulting in an increase of the weight of the cables and the antenna deployment mechanism.

Thus, when the diameter of a deployable antenna reflector is to be increased, the weight of the deployable antenna reflector problematically increases at a high rate.

It is, therefore, an exemplary object of the present invention is to provide a deployable antenna reflector capable of increasing the diameter of a reflector surface by reducing a maximum tensile force caused in a surface cable network while the weight of cables and an antenna deployment mechanism is prevented from increasing.

The aforementioned technology disclosed in U.S. Pat. No. 6,278,416 is to curve (or scallop) the outermost cords, but not to reduce a maximum tensile force. Rather, that technology appears to increase a maximum tensile force. In an antenna disclosed in U.S. Pat. No. 6,278,416, cords are simply arranged in parallel to each other and are not coupled to each other in a mesh pattern.

According to an exemplary aspect of the present invention, a deployable antenna reflector includes a surface cable network formed of a plurality of cables coupled to each other in a mesh pattern. The surface cable network includes at least one rigid rod member that reduces a maximum tensile force caused in the surface cable network.

EXEMPLARY EMBODIMENTS

Exemplary embodiments of the present invention will be described in detail below with reference to drawings attached hereto.

Figure 1:
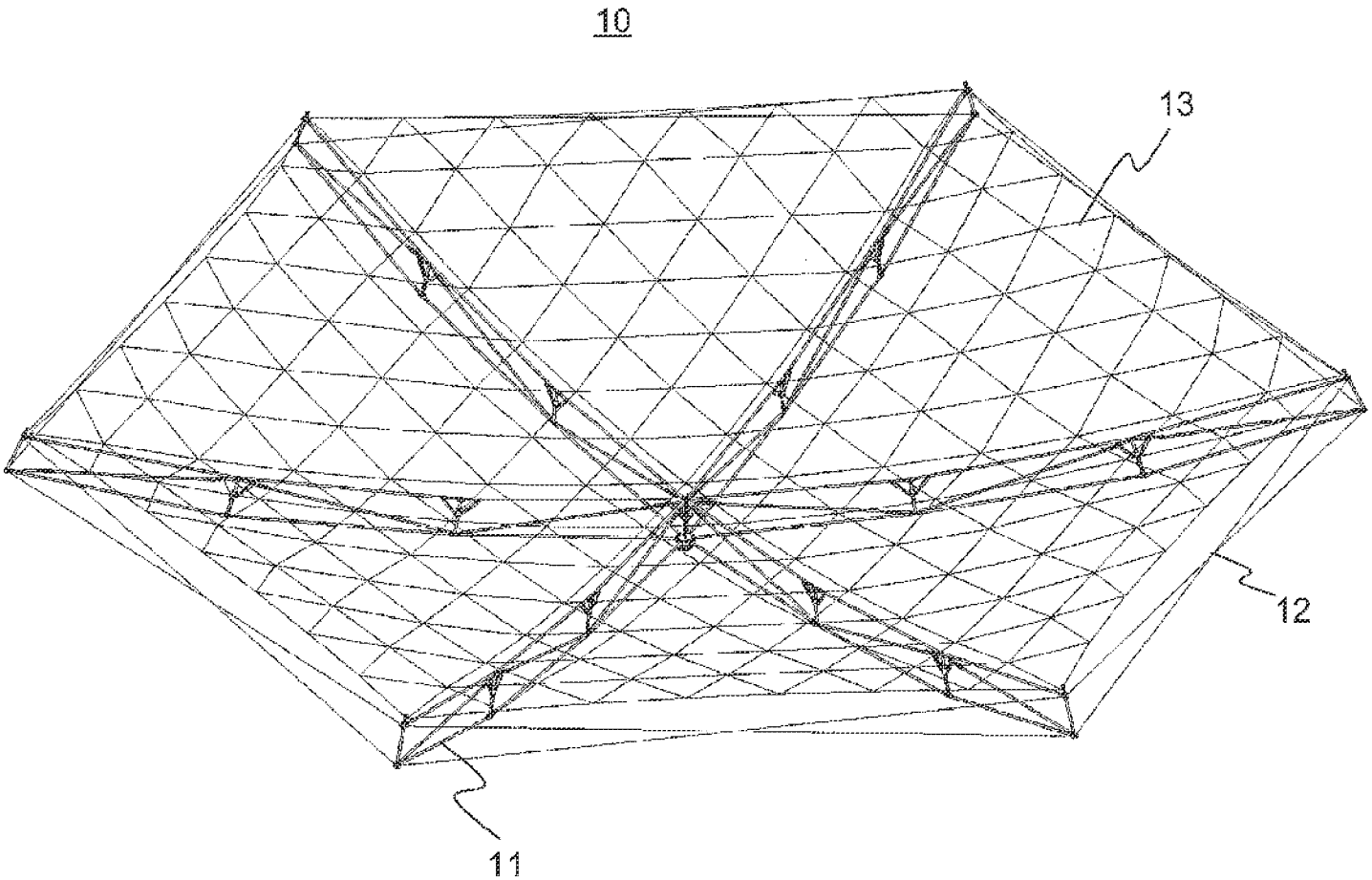
FIG. 1 is a perspective view showing an outlined structure of a deployable antenna reflector according to a first exemplary embodiment of the present invention.

As shown in FIG. 1, a deployable antenna reflector 10 according to a first exemplary embodiment of the present invention includes an antenna deployment mechanism (link mechanism) 11, a band 12 operable to adjust a phase angle of the antenna deployment mechanism 11, and an antenna reflector surface 13. In FIG. 1, the antenna reflector surface 13 is illustrated only by part of a surface cable network (23 in FIG. 2A).

Figure 2A:
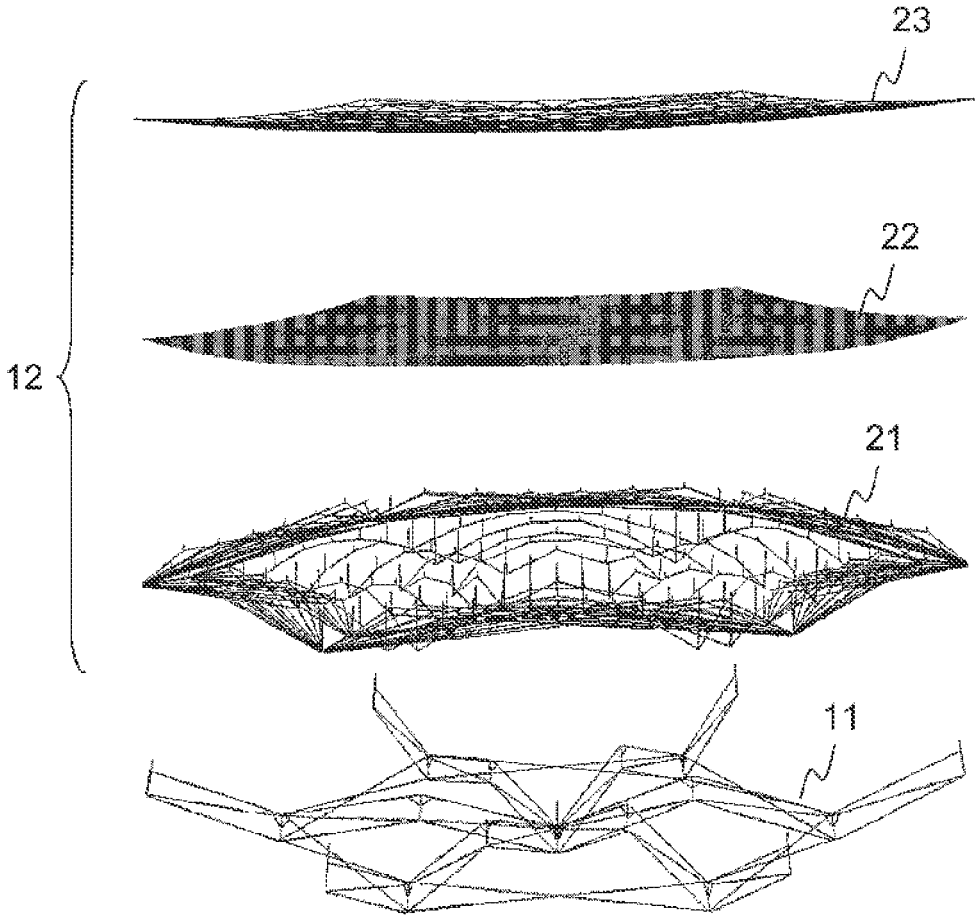
FIG. 2A is an exploded perspective view of the deployable antenna reflector of FIG. 1.

FIG. 2A is an exploded perspective view explanatory of an outlined structure of the deployable antenna reflector 10 shown in FIG. 1.

As shown in FIG. 2A, the deployable antenna reflector 10 includes an antenna deployment mechanism 11, a rear cable network 21, a metal mesh 22, and a surface cable network 23. The rear cable network 21, the metal mesh 22, and the surface cable network 23 constitute the antenna reflector surface 13.

The antenna deployment mechanism 11 is configured to be transformable between a folded state and an unfolded state with a link mechanism. The antenna deployment mechanism 11 has support members provided at vertexes of a polygon (hexagon in this example). The surface cable network 23 is attached to the support members of the antenna deployment mechanism 11.

The rear cable network 21 includes a plurality of cables. The rear cable network 21 is attached to the antenna deployment mechanism 11 and also attached to the surface cable network 23. Cables of the rear cable network 21 that are coupled to the surface cable network 23 may be referred to as tie cables. The rear cable network 21 receives tensile forces upon deployment of the antenna deployment mechanism 11. Furthermore, the rear cable network 21 provides tensile forces to the surface cable network 23 via the tie cables.

The metal mesh 22 has such flexibility that it can be folded. The metal mesh 22 is sewed onto the surface cable network 23.

The surface cable network 23 is formed by a plurality of cables arranged into a mesh pattern having a polygonal profile and multiple facets (meshes). The cables are fixed to each other at intersections thereof. The vertexes of the profile of the surface cable network 23 are fixed to the support members of the antenna deployment mechanism 11. Some of the intersections of the cables are coupled to the rear cable network 21 via the tie cables. For example, the surface cable network 23 may have a hexagonal profile. Each of the facets may have a triangular shape. Nevertheless, the shapes of the profile and the facets are not limited to those mentioned above.

Figure 2B:
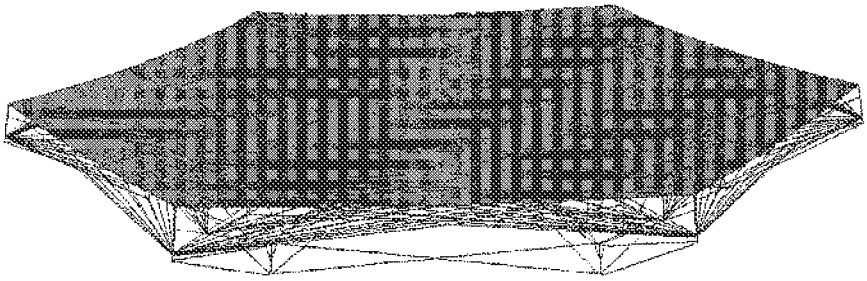
FIG. 2B is a perspective view showing that the deployable antenna reflector of FIG. 2A has been assembled.

The aforementioned components of the antenna deployment mechanism 11, the rear cable network 21, the metal mesh 22, and the surface cable network 23 are combined with each other to produce a deployable antenna reflector 10 as shown in FIG. 2B.

The deployable antenna reflector 10 is housed in a folded state within a fairing of a launch vehicle and, in an outer space, unfolded into an unfolded state shown in FIG. 1. Appropriate tensile forces are applied to the rear cable network 21 and the surface cable network 23 from the antenna deployment mechanism 11 at the unfolded state of the deployable antenna reflector 10. Thus, the metal mesh 22 is unfolded into a predetermined shape so that the metal mesh 22 forms a reflection surface. The metal mesh 22 has a flat surface on each of a plurality of facets of the surface cable network 23. The entire metal mesh 22 forms a polyhedron approximated to a parabola shape.

Figure 3A:
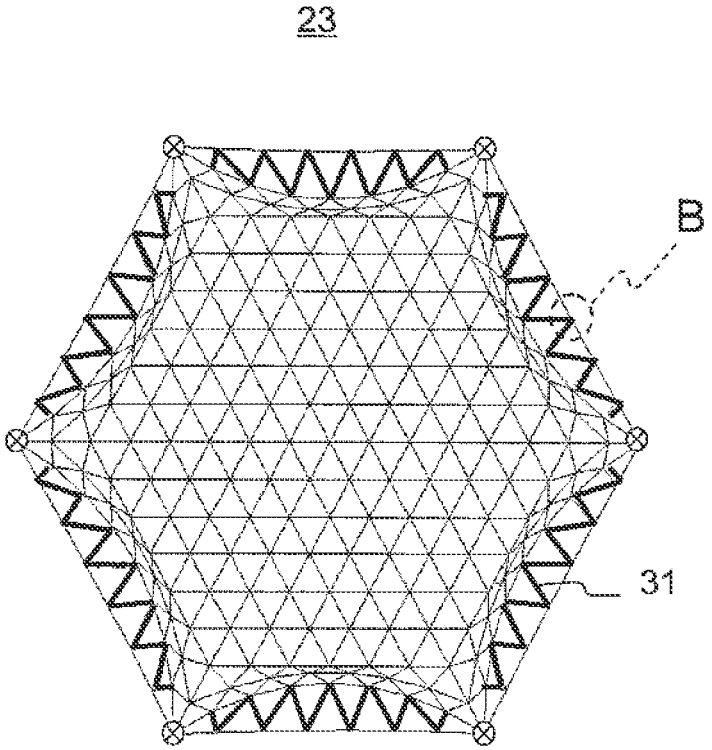
FIG. 3A is a plan view of a surface cable network shown in FIG. 2A.

FIG. 3A is a plan view of the surface cable network 23. In FIG. 3A, the configuration of the surface cable network 23 is illustrated in a more detailed manner than in FIG. 1. Since the surface cable network 23 has such a three-dimensional configuration as to form a parabola surface, slack is caused to part of the surface cable network 23 as shown in FIG. 3A.

The surface cable network 23 of FIG. 3A has a hexagonal profile having a large number of triangular facets inside of the hexagonal profile. Cables extending substantially in parallel to the profile are referred to as circumferential cables. Furthermore, the outermost ones of the circumferential cables, i.e., the cables as edges of the profile are referred to as the outermost cables. The circumferential cables interconnect cables extending radially from the center of the surface cable network 23 to each of the vertexes of the profile.

The surface cable network 23 has at least one rigid rod member 31 that reduces a maximum tensile force caused in the surface cable network 23. In FIG. 3A, the rigid rod members 31 are illustrated as being thicker than the cables.

The rigid rod members 31 are provided near the outermost cables. Specifically, the rigid rod members 31 are provided so as to couple the outermost cables to the circumferential cables located adjacent to the outermost cables. For example, the rigid rod members 31 are made of a lightweight material having a high rigidity such as a carbon fiber reinforced resin. The rigid rod members 31 may have a rigidity that is commensurate with tensile forces to be caused in the surface cable network 23.

Figure 3B:
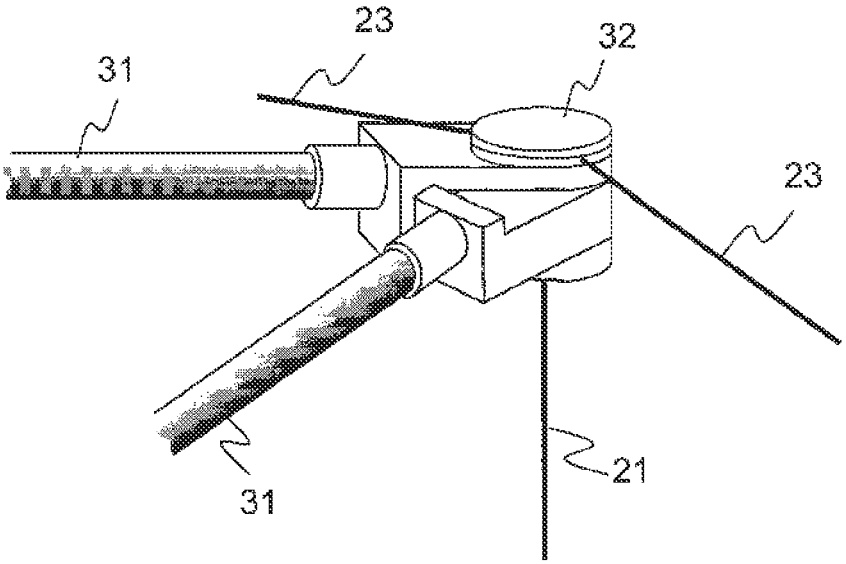
FIG. 3B is a perspective view showing a coupling member used at a portion indicated by a dashed circle B of FIG. 3A.

The rigid rod members 31 can be coupled to the outermost cables or the circumferential cables (the surface cable network 23) with use of coupling members 32 as shown in FIG. 3B. Those coupling members 32 are also coupled to the rear cable network 21 (the tie cables of the rear cable network 21). Each of the coupling members 32 has a rotatable joint and is thus adaptable to a folding operation of the deployable antenna reflector 10. For example, the coupling members 32 may be made of resin.

The rigid rod members 31 can receive either a compressive load or a tensile load. The rigid rod members 31 can also receive a bending load.

Tensile forces caused in the rear cable network 21, the metal mesh 22, and the surface cable network 23 should be balanced at the unfolded state. At that time, if the surface cable network 23 being used includes no rigid rod members 31, then the forces applied to the respective cables should have a positive value (i.e., tensile forces). Furthermore, in order to prevent the cables from being bent against forces directed outward from the reflector surface by the tensile forces of the metal mesh 22 attached to the surface cable network 23 and to maintain the shape of the deployable antenna reflector 10, larger tensile forces are required as compared to a case where only the shapes of the rear cable network 21 and the surface cable network 23 are maintained. Thus, tensile forces of the cables of the surface cable network 23 become larger and larger as the deployable antenna reflector 10 has a larger diameter.

In the present embodiment, the rigid rod members 31 are used for part of the cables of the surface cable network 23. Therefore, portions where the rigid rod members 31 are used can avoid restrictions on a lower limit of tensile forces. Accordingly, tensile forces can be reduced in the entire surface cable network 23. Thus, the maximum tensile force of the surface cable network 23 can be reduced. Furthermore, it is possible to reduce loads applied to the antenna deployment mechanism 11 by the surface cable network 23. Therefore, it is possible to prevent an increase of the weight that would be needed to improve the strength of the antenna deployment mechanism 11. In this manner, there can be provided a deployable antenna reflector that can reduce in size at a folded state and increase in diameter at an unfolded state while the weight of the deployable antenna reflector is prevented from increasing.

Figure 4:
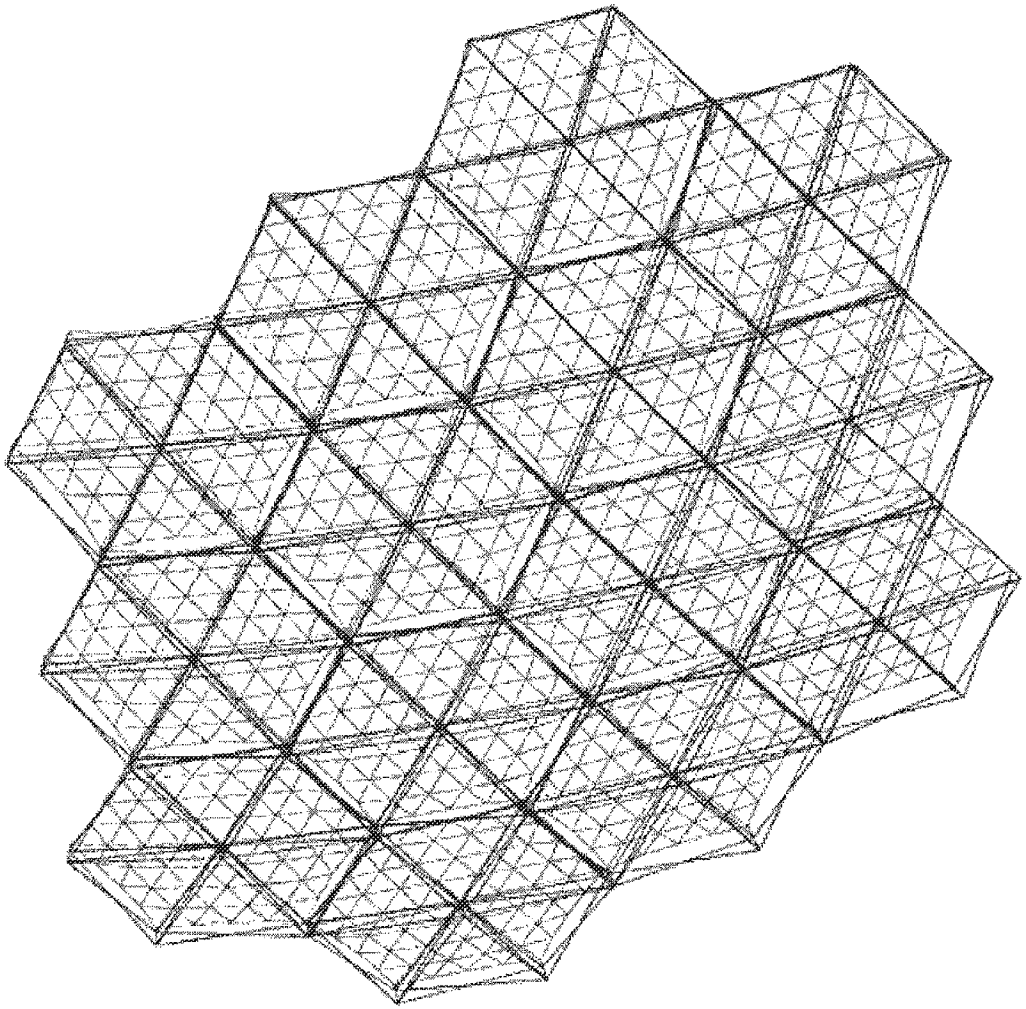
FIG. 4 is a diagram showing an outlined structure of a large-sized deployable antenna reflector system having a plurality of unit modules of the deployable antenna reflectors according to the first exemplary embodiment.

The deployable antenna reflector according to the present embodiment may be used as a unit module, and a plurality of such unit modules may be coupled to each other to provide a larger deployable antenna reflector (deployable antenna reflector system) as shown in FIG. 4. In the exemplary example of FIG. 4, the deployable antenna reflector system includes 14 modules. Nevertheless, the deployable antenna reflector system may have any number of modules.

Now a second exemplary embodiment of the present invention will be described.

Figure 5A:
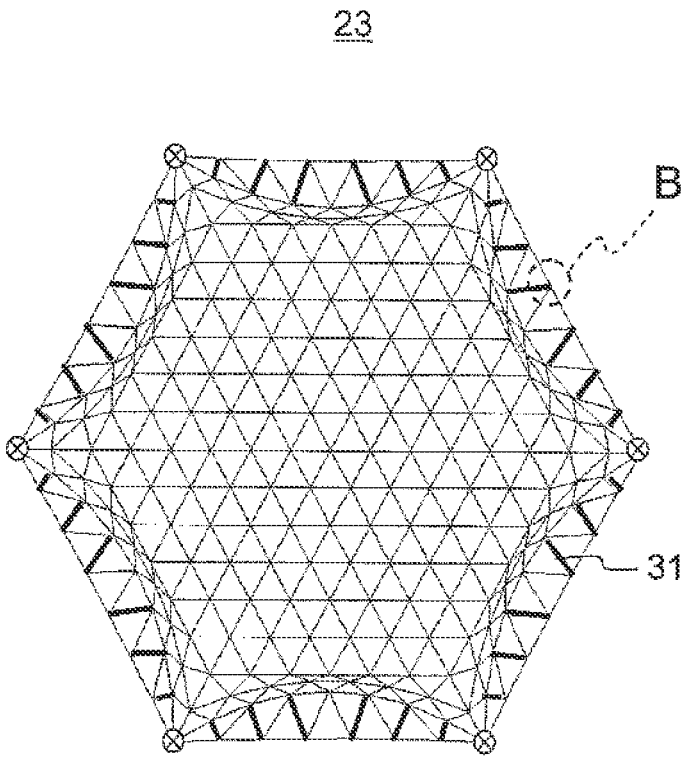
FIG. 5A is a plan view of a surface cable network used in a deployable antenna reflector according to a second exemplary embodiment of the present invention.

In the first exemplary embodiment, the rigid rod members 31 are used for all of connections between the outermost cables and the circumferential cables located adjacent to the outermost cables. In the second exemplary embodiment, however, the rigid rod members 31 are used for some of connections between the outermost cables and the circumferential cables located adjacent to the outermost cables as shown in FIG. 5A, whereas cables are used for the rest of the connections. In FIG. 5A, the rigid rod members 31 are illustrated as being thicker than the cables.

At least one rigid rod member 31 is required. Nevertheless, in the present embodiment, half of connections between the outermost cables and the circumferential cables located adjacent to the outermost cables are formed by rigid rod members 31 in view of the tensile force distribution. Specifically, in the exemplary example shown in FIG. 5A, one of two cables defining a facet with a vertex located on the outermost cable that is located closer to an end of the outermost cable (the vertex of the profile) is replaced with a rigid rod member 31.

Figure 5B:
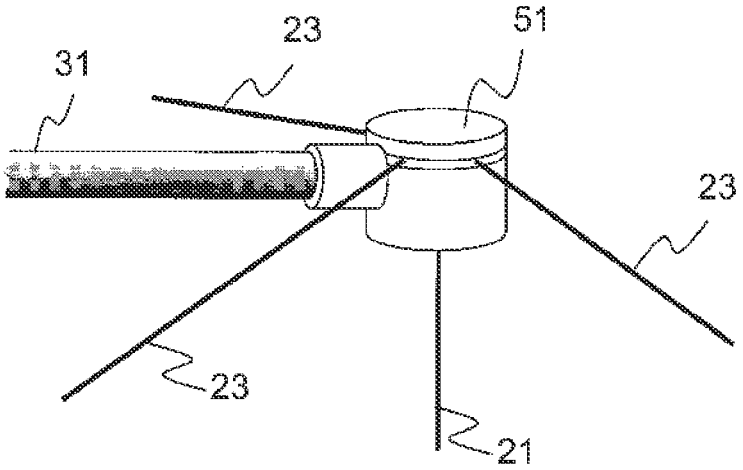
FIG. 5B is a perspective view showing a coupling member used at a portion indicated by a dashed circle B of FIG. 5A.

As shown in FIG. 5B, the present embodiment can exhibit advantageous effects that each of coupling members 51 can be simplified as compared to the coupling member 32, in addition to the same advantageous effects as the first exemplary embodiment. The coupling members 51 require no rotatable joint.

Figure 6:
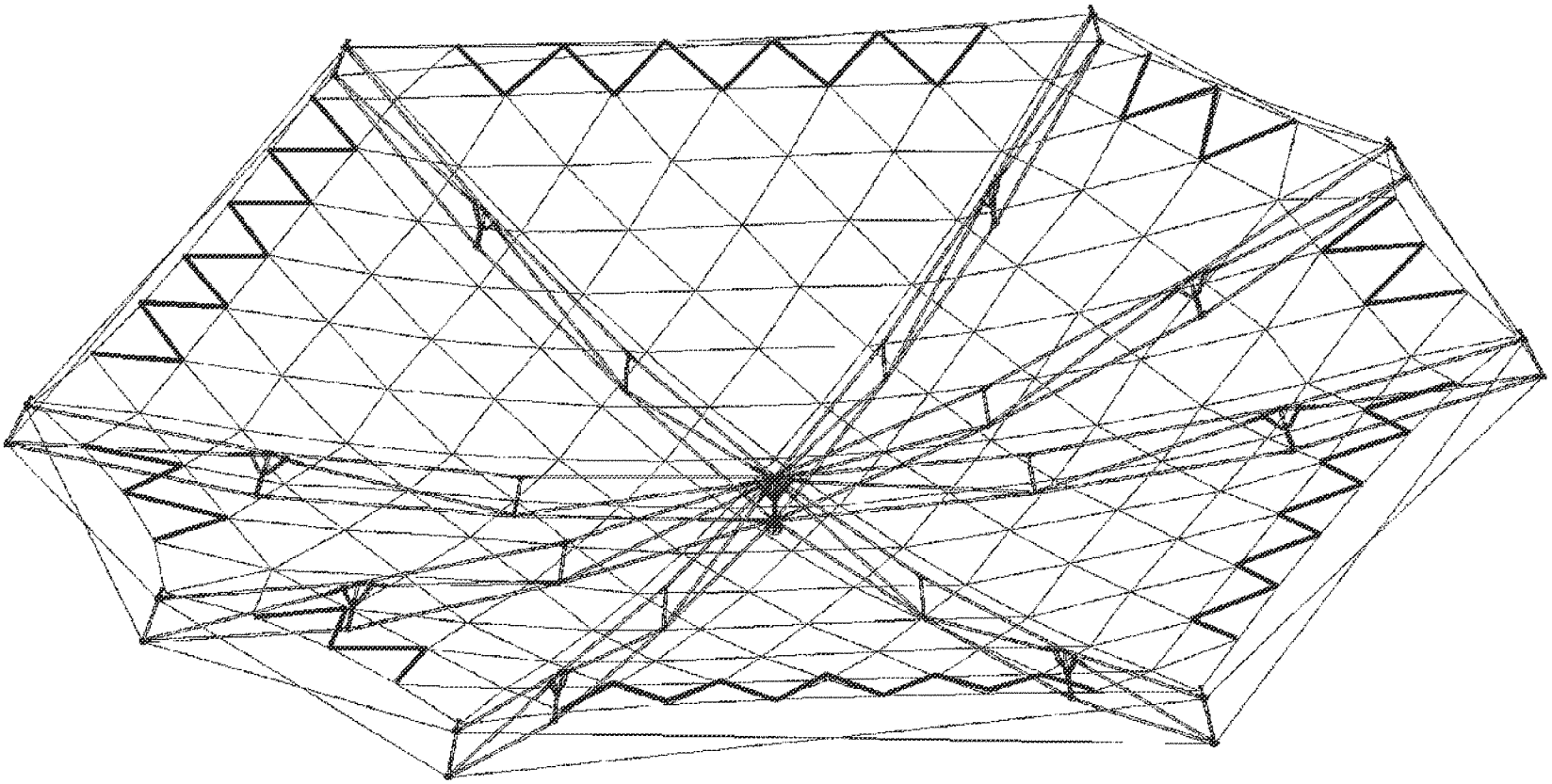
FIG. 6 is a perspective view showing an outlined structure of a deployable antenna reflector according to another exemplary embodiment of the present invention.

Although the present invention has been described along with some exemplary embodiments, the present invention is not limited to the aforementioned exemplary embodiments. A variety of modifications and changes may be made to the above exemplary embodiments. For example, the shape of the deployable antenna reflector is not limited to a hexagon, and the deployable antenna reflector may have an octagonal shape as in another exemplary embodiment shown in FIG. 6, a regular octagonal shape, or other polygonal shapes. In FIGS. 3A and 5A, ends of the outermost cables and the circumferential cables located adjacent to the outermost cables are fixed to the support members of the antenna deployment mechanism 11. Nevertheless, the ends of the circumferential cables located adjacent to the outermost cables may be arranged at positions that are different from the positions of the ends of the outermost cables (at positions closer to the center of the antenna deployment mechanism 11). The number and positions of the rigid rod members 31 may be varied in an appropriate manner depending upon a tensile force distribution in the surface cable network 23.

What is claimed is:

1. A deployable antenna reflector comprising:

a surface cable network comprising a plurality of cables which are coupled to each other, and wherein the plurality of cables comprises outermost cables and circumferential cables adjacent to the outermost cables, a metal mesh which underlies the surface cable network and which is sewn onto the surface cable network, and a rear cable network which is located under the metal mesh and which comprises tie cables coupled to the surface cable network and extending to the surface cable network through the metal mesh wherein:

the surface cable network further comprises at least one rigid rod member extending between the outermost cables and the circumferential cables in a radial direction intersecting with the tie cables; and the at least one rigid rod member is sewn in the metal mesh and couples at least one of the outermost cables to at least one of the circumferential cables thereby reducing a maximum tensile force caused in the surface cable network.

2. The deployable antenna reflector as recited in claim 1, wherein the at least one rigid rod member replaces part of cables defining a facet of the surface cable network.

3. The deployable antenna reflector as recited in claim 2, wherein the facet has a triangular shape.

4. The deployable antenna reflector as recited in claim 3, wherein the facet has a vertex located on the outermost cable, and the at least one rigid rod member is located on at least one of two sides of the facet extending from the vertex.

5. The deployable antenna reflector as recited in claim 4, wherein the at least one rigid rod member is located on each of the two sides of the facet extending from the vertex.

6. The deployable antenna reflector as recited in claim 4, wherein the at least one rigid rod member is located on one of the two sides of the facet extending from the vertex that is closer to an end of the at least one of the outermost cables.

7. The deployable antenna reflector as recited in claim 1, wherein an end of the at least one of the circumferential cables is connected to an end of the at least one of the outermost cables.

8. The deployable antenna reflector as recited in claim 1, further comprising:

a support member that supports vertexes of a profile of the surface cable network;

an deployment mechanism to which the support member is attached; and the rear cable network is attached to the deployment mechanism;

wherein the metal mesh is attached to the surface cable network so that the metal mesh is arranged between the surface cable network and the rear cable network.

9. The deployable antenna reflector as recited in claim 1, wherein a polygonal shape of the surface cable network and formed with an edge of the at least one of the outermost cables comprises a hexagonal shape.

10. The deployable antenna reflector as recited in claim 1, wherein a polygonal shape of the surface cable network and formed with an edge of the at least one of the outermost cables comprises an octagonal shape.

11. The deployable antenna reflector as recited in claim 1, further comprising a coupling member that couples the at least one rigid rod member to at least one of the plurality of cables.

12. The deployable antenna reflector as recited in claim 1, wherein the at least one rigid rod member receives a compressive load.

13. The deployable antenna reflector as recited in claim 1, wherein the at least one rigid rod member is made of a carbon fiber reinforced resin.

14. A deployable antenna reflector system comprising:

a plurality of unit modules coupled to each other, each of the plurality of unit modules comprising the deployable antenna reflector as recited in claim 1.

* * * * *